United States Patent [19]

Kemper et al.

[11] 4,422,950

[45] Dec. 27, 1983

[54] BLEACH ACTIVATOR GRANULES AND PREPARATION THEREOF

[75] Inventors: Hermanus C. Kemper, Brielle; Pieter Versluis, Rotterdam, both of Netherlands

[73] Assignee: Lever Brothers Company, New York, N.Y.

[21] Appl. No.: 327,535

[22] Filed: Dec. 4, 1981

[30] Foreign Application Priority Data

Dec. 9, 1980 [GB] United Kingdom ..... 8039373

[51] Int. Cl.[3] ..... C11D 3/395; C11D 7/54

[52] U.S. Cl. ..... 252/186.38; 8/111; 252/95; 252/99; 252/186.3; 252/186.31; 252/186.39; 252/186.4

[58] Field of Search ..... 252/186.38, 186.3, 186.31, 252/186.39, 186.4, 95, 99; 8/111 A, 111 R

[56] References Cited

U.S. PATENT DOCUMENTS

| | | | |
|---|---|---|---|
| 3,163,606 | 12/1964 | Viveen et al. | 252/98 |
| 3,338,839 | 8/1967 | MacKellar et al. | 252/186.38 |
| 3,661,789 | 5/1972 | Corey et al. | 252/186.31 |
| 3,671,439 | 6/1972 | Corey et al. | 252/186.38 |
| 3,779,931 | 12/1973 | Fries et al. | 252/99 |
| 3,945,936 | 3/1976 | Lucas et al. | 252/186.38 |
| 4,003,841 | 1/1977 | Hachmann et al. | 252/99 |
| 4,064,062 | 12/1977 | Yurko | 252/186.31 |

FOREIGN PATENT DOCUMENTS

| | | |
|---|---|---|
| 2652488 | 5/1978 | Fed. Rep. of Germany . |
| 795618 | 5/1958 | United Kingdom . |
| 836988 | 6/1960 | United Kingdom . |
| 855735 | 12/1960 | United Kingdom . |
| 907356 | 10/1962 | United Kingdom . |
| 907358 | 10/1962 | United Kingdom . |
| 1003310 | 9/1965 | United Kingdom . |
| 1226493 | 3/1971 | United Kingdom . |
| 1360427 | 7/1974 | United Kingdom . |
| 1395006 | 5/1975 | United Kingdom . |
| 1398785 | 6/1975 | United Kingdom . |
| 1441416 | 6/1976 | United Kingdom . |
| 2015050 | 12/1978 | United Kingdom . |
| 1557568 | 12/1979 | United Kingdom . |
| 1585476 | 3/1981 | United Kingdom . |

*Primary Examiner*—Irwin Gluck

*Attorney, Agent, or Firm*—Amirali Y. Haidri; James J. Farrell

[57] ABSTRACT

Effervescent bleach activator granules for use in washing and/or bleaching compositions comprising a bleach activator, a peroxoborate and a binding material are disclosed. Preferred granules include an alkali metal perborate monohydrate, preferably in a proportion at least equal to the amount of the bleach activator. These granules have the advantage that the reduction of mechanical loss when used in washing machines combined with a fast dissolution of and reaction between the bleach activator and the percompound in close proximity at a high local pH should improve the bleach performance, particularly in the low/medium temperature range, to a substantial degree.

12 Claims, No Drawings

BLEACH ACTIVATOR GRANULES AND PREPARATION THEREOF

The invention relates to bleach activator granules for use in washing and/or bleaching compositions and the preparation of said bleach activator granules.

Washing compositions which contain so-called bleach activators in addition to bleaching percompounds as well as the usual detergent substances having a cleaning action and builder salts are known e.g. from U.S. Pat. Nos. 3,163,606 and 3,779,931 and British Patent Specification Nos. 836,988; 855,735; 907,356; 907,358; 1,003,310 and 1,226,493. These activators usually comprise carboxylic acid derivatives which in aqueous bleach solutions react with the percompounds e.g. sodium perborate, with the formation of peroxyacids and therefore increase the bleaching action of the mixtures or make it possible to effect bleaching at relatively low or moderate washing temperatures. The term "percompound" is used here to indicate those percompounds which in solution release active oxygen, such as perborates, percarbonates, perphosphates and persilicates.

In order to improve the storage properties of such washing compositions it is also known to present the bleach activator in the form of granulated particles, as agglomerates or coated particles. Usually a carrier or a binding material is required to prepare such particles which have a size of from about 0.1–2.0 mm. Various methods to prepare such bleach activator granules have been suggested and described in the patent literature, as for instance in the British Patent Specification Nos. 1,360,427; 1,398,785; 1,395,006 and 1,441,416; the British Patent Application No. 2,015,050 and the U.S. Pat. No. 4,003,841.

One major drawback of coarse granules is however that they tend to sediment in the washing machine where they remain substantially inactive during the whole washing operation. This phenomenon of material loss referred to here as mechanical loss, which can be defined as the difference between the dosed amount and the amount that is found back in the wash solution, can be very serious. For bleach activator granules the range of mechanical loss may vary between 5 and 70% by weight or even more, depending on the washing machine type. The result is a reduced peroxy acid yield and consequently a reduced bleach efficiency.

It is therefore an object of the present invention to improve the peroxy acid yield of bleach activator/percompound systems.

It is another object of the invention to improve the bleach efficiency of bleaching and cleaning compositions comprising a percompound and a bleach activator for said percompound.

Still a further object of the invention is to provide bleach activator granules showing reduced sedimentation tendency in the washing machine.

These and other objects, which will be apparent from the further description of the invention, can be achieved if a bleach activator is provided in the form of granules comprising said bleach activator, an alkalimetal or alkaline earth metal peroxoborate and a binding material.

The bleach activators utilizable according to the invention may be any bleach activator compound which reacts with a percompound forming a peroxyacid, e.g. of the class of carboxylic anhydrides, carboxylic acid esters and N-acyl or O-acyl substituted amides or amines. Such bleach activators are described for example in a series of articles by Allan H. Gilbert in Detergent Age, June 1967 pages 18–20, July 1967 pages 30–33, and August 1967 pages 26, 27 and 67. A representative but by no means comprehensive list of activators which can be used in the present invention is given below:

(a) N-diacylated and N,N′-tetraacylated amines, such as N,N,N′,N′-tetraacetylmethylenediamine or -ethylenediamine, N,N-diacetylaniline and N,N-diacetyl-p-toluidine or 1,3-diacylated hydantoins, as for example, the compounds 1,3-diacetyl-5,5-dimethylhydantoin and 1,3-dipropionylhydantoin;

(b) N-alkyl-N-sulphonyl-carbonamides, for example the compounds N-methyl-N-mesyl-acetamide, N-methyl-N-mesylbenzamide, N-methyl-N-mesyl-p-nitrobenzamide, and N-methyl-N-mesyl-p-methoxybenzamide;

(c) N-acylated cyclic hydrazides, acylated triazoles or urazoles, for example monacetylmaleic acid hydrazide;

(d) O,N,N-trisubstituted hydroxylamines, such as O-benzoyl-N,N-succinylhydroxylamine, O-acetyl-N,N-succinyl-hydroxylamine, O-p-methyoxybenzoyl, N,N-succinyl-hydroxylamine, O-p-nitrobenzoyl-N,N-succinyl-hydroxylamine and O,N,N-triacetyl-hydroxylamine;

(e) N,N′-diacyl-sulphurylamides, for example N,N′-dimethyl-N,N′-diacetylsulphurylamide and N,N′-diethyl-N,N′-dipropionyl-sulphurylamide;

(f) Triacyl cyanurates, for example triacetyl cyanurate and tribenzoyl cyanurate;

(g) Carboxylic acid anhydrides, such as benzoic anhydride, m-chlorobenzoic anhydride, phthalic anhydride, and 4-chlorophtalic anhydride;

(h) Sugar esters, for example glucose pentaacetate;

(i) 1,3-diacyl-4,5-diacyloxy-imidazolidines, for example 1,3-diformyl-4,5-diacetoxy-imidazolidine, 1,3-diacetyl-4,5-diacetoxy-imidazolidine, 1,3-diacetyl-4,5-dipropionyloxy-imidazolidine;

(j) Tetraacetylglycoluril and tetrapropionylglycoluril;

(k) Diacylated 2,5-diketopiperazines, such as 1,4-diacetyl-2,5-diketopiperazine, 1,4-dipropionyl-2,5-diketopiperazine and 1,4-dipropionyl-3,6-dimethyl-2,5-diketopiperazine;

(l) Acylation products of propylenediurea and 2,2-dimethylpropylenediurea, especially the tetraacetyl or tetrapriopionyl propylenediurea and their dimethyl derivatives;

(m) Carbonic acid esters, for example the sodium salts of p-(ethoxycarbonyloxy-benzoic acid and p-(propoxycarbonyloxy)-benzenesulphonic acid;

(n) alpha-acyloxy-(N,N′)polyacylmalonamides, such as alpha-acetoxy-(N,N′)-diacetylmalonamide.

N,N,N′,N′-Tetraacetylethylenediamine (TAED) mentioned under (a) is of particular interest in view of safety and biodegradability.

The term "peroxoborate" is used here to indicate a particular form of perborate obtained by heat treatment of perborate monohydrate, which on contact with water releases molecular oxygen. This oxygen is generally termed as developable oxygen, as distinct from active or available oxygen used to indicate the reactive oxygen released by bleaching percompounds.

The form of perborate, termed here as "peroxoborate" has been used as a constituent of e.g. denture cleansers in tablet form to effect effervescence when the tablet is placed in water.

The term "peroxoborate" is preferred here to the use of the prefix or suffix "anhydrous", since in the literature this prefix is often used in a confusing manner to indicate ($NaBO_2.H_2O_2$), known as perborate monohydrate.

A method of preparing sodium peroxoborate is for example as given below:

Sodium perborate monohydrate is heated under vacuum (about 0.5 mm Hg) in a round bottom flask with a slowly rotating evaporator for about 2 hours. Heating is effected with the aid of an oil bath at a temperature of about 120° C. At complete conversion every Mol of sodium perborate monohydrate $(NaBO_2.H_2O_2)_2$ will release two Mols of water i.e. 18% by weight. Under the conditions as applied above about 50% of the perborate monohydrate was converted as determined by iodometric titration. The product thus obtained comprising a mixture of sodium perborate monohydrate and sodium peroxoborate can be used for preparing the bleach activator granules of the invention.

Accordingly the invention provides bleach activator granules of a size of from 0.1 to 2.0 mm and comprising a bleach activator, an alkalimetal or alkaline earth metal peroxoborate and a binding material.

A preferred peroxoborate is sodium peroxoborate.

The presence of peroxoborate in the granules causes the granules to effervesce so that mechanical losses are decreased to a substantial degree.

The rate and type of effervescence determine the reduction of mechanical losses, as can be measured from the peroxy acid yield. Theoretical calculations based on oxygen evolution/flotation estimates suggest that a peroxoborate content in the granules as low as 2.0% by weight may be more than sufficient to achieve the desired effect. However, a minimum of about 5% by weight is conveniently used in the practice of the invention.

Furthermore the peroxoborate provides an alkaline reaction to the granules which is of advantage for optimal peroxyacid formation, which is not the case with an acid effervescent system as disclosed in U.S. Pat. No. 4,252,664.

Generally the granules will comprise from about 5%, preferably from 10–70% by weight of bleach activator compound, from about 10%, preferably from 20–50% by weight of peroxoborate, and from about 5, preferably from 10–50% by weight of binding material.

The type of binding material or carrier is not critical, though some binding materials are preferred to other ones. Any binding material or binding material system already suggested for preparing bleach activator granules may be used, such as nonionic surfactants, fatty acids, sodium carboxymethylcellulose, gelatin, polyethylene glycol, fatty alcohols, sodium triphosphate, potassium triphosphate, disodium orthophosphate, magnesium sulphate, silica, clay, various alumino silicates, water, and mixtures thereof, though care must be taken in using water as binding material, since too much water could cause premature decomposition of the peroxoborate and also affect the storage stability of the granules.

The binding material is capable of giving strength to the granule, protecting the components from outside influences, inert to the bleach activator and soluble or dispersible in a wash liquor.

Preferably the granules also comprise an alkali metal perborate monohydrate, preferably in a proportion by weight at least equal to the amount of the bleach activator. A preferred alkali metal perborate monohydrate is sodium perborate monohydrate ($NaBO_2.H_2O_2$).

These granules will have the further advantage that the bleach activator is in direct contact with the percompound, i.e. a fast dissolving alkali metal perborate monohydrate, which favours the formation of peroxy acid on contact with water.

In preparing the granules the solid particulate or powdered bleach activator can be mixed with the peroxoborate, preferably in admixture with perborate monohydrate, whereupon the mixture is sprayed with a liquid or liquefied binding material. Suitable equipments for carrying out the granulation process are for example a Shugi Flexomix or a rotating pan granulator, though any other granulation technique and/or method known in the art may also be usefully applicable. As to the average particle size of the bleach activator compound for preparing the granules, best results are obtained with bleach activators of average particle size below 0.25 mm., preferably below 0.15 mm.

Especially suitable bleach activator material is tetraacetylethylene diamine with an average particle size of between 0.10 and 0.15 mm. and containing less than about 25% fines of a size below 0.05 mm. If crystalline material is used having e.g. a needle-like crystal shape, the above dimensions refer to the needle-diameter allowing the needle-like crystals to pass through or be retained by a sieve of the required mesh.

The granule size is preferably kept so as to have a major part of it ranging between 0.3 to 0.9 mm.

Desirably the granules should have a pH within a range of about 10–11.5, preferably about 10.5, for optimum peroxyacid formation. This pH range is normally achievable already by the use of peroxoborate, though if necessary, alkaline material and/or buffering agents may also be used for adjusting the pH.

Accordingly, in a preferred embodiment of the invention the bleach activator/peroxoborate granules comprise a bleach activator of average particle size 0.15 mm. and an alkali metal perborate monohydrate and having a pH in the range of between 10 and 11.5.

The major advantage of said preferred granules is that the reduction of mechanical loss in washing machines combined with a fast dissolution of and reaction between the bleach activator and the percompound (perborate) in close proximity at a high local pH should improve bleach performance, particularly in the low/-medium temperature range, to a substantial degree.

Other useful adjuncts e.g. stabilizing agents, such as ethylenediaminetetraacetate and the various known organic phosphonic acids and/or their salts, for example ethylenediamine tetra (methylene phosphonic acid), may also be incorporated. Further inert fillers, builders such as sodium triphosphate and alumino silicates, and other minor ingredients may be incorporated as desired, so long as they do not adversely affect the solubility and/or stability of the granules.

The invention will now be illustrated by way of the following Examples.

EXAMPLES I–IV

Bleach activator granules of the invention having the following compositions were prepared:

| Granule composition (% by weight) | I | II | III | IV |
|---|---|---|---|---|
| TAED (av. part. size < 0.15 mm) | — | 17.5 | 21.0 | 11.0 |

-continued

| Granule composition (% by weight) | I | II | III | IV |
|---|---|---|---|---|
| TAED (av. part. size > 0.15 mm) | 17.5 | — | — | — |
| Sodium perborate monohydrate | 24.0 | 21.0 | 28.0 | 15.0 |
| Sodium peroxoborate | 25.0 | 23.0 | 26.0 | 20.5 |
| Sodium triphosphate | 4.5 | 4.5 | 5.5 | 3.0 |
| Ethylenediamine-tetra(methylene phosphonic acid) - EDTMP | 2.5 | 2.0 | 3.0 | 1.5 |
| Ukanil 87 ®* | 17.0 | — | — | — |
| Tallow fatty alcohol/25 ethylene oxide | — | 32.0 | — | 14.0 |
| $C_{10-15}$ alcohol/7 ethylene oxide | — | — | 16.5 | — |
| Myristic acid | — | — | — | 25.0 |
| Water | 9.5 | — | — | — |
| Zeolite A4 | — | — | — | 10.0 |
| pH (5 g granules in 5 g water) | 10.4 | — | 10.4 | — |

*Ukanil 87 is a 68/32 $C_{13}/C_{15}$ straight chain alcohol mixture condensed with 11 ethylene oxide groups, a nonionic detergent supplied by the Produits Chimique Ugine Kuhlman Company.

The granules were tested in washing machine experiments for peroxy acid yield and total active oxygen yield using two types of washing machines viz. "AEG Turnamat" and "Brandt 412", and compared with granules (A) and (B) of the following compositions.

| Granule composition (% by weight) | A | B |
|---|---|---|
| TAED (av. part. size 0.15 mm) | — | 18.0 |
| TAED (av. part. size 0.15 mm) | 65 | — |
| Sodium triphosphate | 21 | 5.0 |
| Sodium perborate monohydrate | — | 31.0 |
| Potassium triphosphate | 8 | — |
| Water | 6 | — |
| EDTMP | — | 3 |
| $C_{10-15}$ alcohol/7 EO | — | 15.0 |
| Sodium sulphate | — | 28.0 |

To 75 grams of a base powder of the following composition, the granules were added up to a level of 2 grams TAED.

| Composition of base powder | (% by weight) |
|---|---|
| Sodium alkylbenzene sulphonate | 8.0 |
| Nonionic ethylene oxide condensation product | 3.5 |
| Sodium stearate (soap) | 6.0 |
| Sodium triphosphate | 42.0 |
| Sodium silicate | 7.5 |
| Sodium carboxymethylcellulose | 1.2 |
| Optical bleach | 0.3 |
| Sodium sulphate | 19.2 |
| Water | 12.3 |

If the granules contained no sodium perborate (granule A), the latter was added in a quantity equivalent to an equivalent ratio of perborate/TAED of about 2.5.

If the granules contained no EDTMP-stabiliser (granule A), the latter was added in an amount corresponding to about 10% by weight of the TAED.

These measures were deemed necessary to have an as good a comparison of the conditions as possible.

After thoroughly mixing the components, the product was poured into the dispenser of the washing machine, which was then set at a heat-up to 60° C. main-wash-only programme using tap water of 8° German hardness.

During the wash cycle samples were taken from the suds at regular intervals and analysed for peroxy acid and total active oxygen yield. Two to four minutes after the maximum yield was reached the programme was stopped.

The following results were obtained:

TABLE I

| Machine | Granule | Equivalent ratio perborate/TAED | TAED part. size (mm) | Perborate hydrate | Max. yield (%) peroxy acid | Max. yield (%) total active oxygen |
|---|---|---|---|---|---|---|
| AEG Turnamat | I | 2.3 | >0.15 | mono | 59 | 90 |
| AEG Turnamat | II | 2.2 | <0.15 | " | 82 | 82 |
| AEG Turnamat | II | 2.7 | <0.15 | " | 81 | 82 |
| AEG Turnamat | IV | 1.5 | <0.15 | " | 84 | 98 |
| AEG Turnamat | A | 2.6 | >0.15 | " | 29 | 80 |
| AEG Turnamat | B | 1.8 | <0.15 | " | 50 | 56 |
| Brandt 412 | III | 2.2 | <0.15 | " | 70 | 95 |
| Brandt 412 | A | 2.6 | >0.15 | tetra | 50 | 79 |

From the above results the improved peroxy acid yield of the granules of the invention (I–IV) in the AEG Turnamat machine is clearly shown.

An improved performance of granules III of the invention is also shown in the Brandt 412 machine.

EXAMPLE V

Bleach activator granules of Example III were mixed with the base powder as used in Examples I–IV and tested in washing machine experiments for peroxy acid and total active oxygen yield. The tests were carried out under the same conditions as used in Examples I–IV except that 4 kg of clean wash load was added.

For comparison a bleach activator granule C of the following composition was used:

| Granule composition C | % by weight |
|---|---|
| TAED (av. part. size 0.15 mm) | 60 |
| Sodium triphosphate | 18 |
| Potassium triphosphate | 18 |
| Water | 4 |

The following results were obtained:

TABLE II

| Machine | Granule | Equivalent ratio perborate/TAED | TAED part. size (mm) | Perborate hydrate | Max. yield (%) peroxy acid | Max. yield (%) total active oxygen |
|---|---|---|---|---|---|---|
| AEG Turnamat | III | <1.5 | 0.15 | mono | 72 | 100 |
| AEG Turnamat | C | <1.5 | 0.15 | tetra | 36 | 42 |

The improved peroxy acid yield obtained with the granules of the invention is again shown in the above Table.

EXAMPLES VI–VIII

Further granules of the following compositions were produced in a Shugi Flexomix Apparatus.

| Granule composition (% by weight) | VI | VII | VIII |
|---|---|---|---|
| TAED (av. part. size 0.15 mm) | 21.5 | 28.0 | 28.0 |
| Sodium perborate monohydrate | 21.5 | 28.0 | 28.0 |
| Sodium peroxoborate | 27.0 | 17.0 | 15.0 |
| EDTMP | 2.1 | — | 2.0 |
| Tallow fatty alcohol/25 ethylene oxide | 19.9 | 19.0 | 19.0 |
| Lauric acid | 8.0 | 8.0 | 8.0 |

The granules were free flowing, homogeneous, showed low compressibility, and had a bulk density and granulometry which would enable them to mix well with a detergent powder. The quantity of oversize (i.e. $>1900\mu$) was between 7–10% by weight, but as the granules were fairly crisp, comminution was not difficult.

Experiments with these granules showed that more than 80% peroxy acid yields were consistently achieved in the washing machine. For comparison the following granules formulated with an acid/bicarbonate effervescent system of the art were prepared.

| Granule composition (% by weight) | D | E |
|---|---|---|
| TAED (av. part. size 0.15 mm) | 22 | 37 |
| Sodium triphosphate | 32 | — |
| Citric acid $H_2O$ | 5 | — |
| Sodium bicarbonate, anhydrous | 8.5 | 47 |
| Tallow fatty alcohol/25 ethylene oxide | 21.5 | — |
| Arquat ® 2HT-cationic surfactant | 11 | — |
| Lauric acid | — | 16 |
| pH | 7.5 | 7.5 |

These granules were used with sodium perborate monohydrate at a TAED/perborate ratio of 2.5/5.

The maximum peroxy acid yield for granule D was 18% and for granule E 40%.

EXAMPLE IX

The following granules within the invention were formulated:

| | |
|---|---|
| TAED | 40% |
| Sodium peroxoborate | 25% |
| Sodium triphosphate | 10% |
| Tallow fatty alcohol/25 ethylene oxide | 10% |
| Myristic acid | 15%. |

We claim:

1. Effervescent bleach activator granules for use in washing and/or bleaching compositions, of a size of from 0.1 to 2.0 mm, comprising (a) a bleach activator which in aqueous solutions reacts with a bleaching percompound which in aqueous solution releases active oxygen, to form a peroxy acid;

(b) a peroxoborate of a metal selected from the group consisting of alkali metals, alkaline earth metals and mixtures thereof which on contact with water releases molecular oxygen causing the granules to effervesce; thereby reducing losses due to incomplete dissolution to a substantial degree; and (c) a carrier which is inert to the bleach activator and soluble or dispersible in the wash liquor.

2. Bleach activator granules according to claim 1, wherein said peroxoborate is sodium peroxoborate.

3. Bleach activator granules according to claim 1, comprising at least about 5% by weight of said peroxoborate.

4. Bleach activator granules according to claim 3, comprising from about 5 to 70% by weight of said bleach activator, from about 10 to 50% by weight of said peroxoborate and from about 5 to 50% by weight of said carrier.

5. Bleach activator granules according to claim 4, comprising from 10–70% by weight of said bleach activator, from 20–50% by weight of said peroxoborate, and from 10–50% by weight of said carrier.

6. Bleach activator granules according to claim 1, which further includes an alkali metal perborate monohydrate.

7. Bleach activator granules according to claim 6, wherein said alkali metal perborate monohydrate is present in a proportion by weight at least equal to the amount of the bleach activator.

8. Bleach activator granules according to claim 6, wherein said alkali metal perborate monohydrate is sodium perborate monohydrate ($NaBO_2.H_2O_2$).

9. Bleach activator granules according to claim 1, wherein said bleach activator is N,N,N',N'-tetraacetylethylenediamine.

10. Bleach activator granules according to claim 1, wherein said bleach activator has an average particle size of below 0.15 mm.

11. Bleach activator granules according to claim 1, having a pH within the range of from 10 to 11.5.

12. Bleach activator granules according to claim 1, wherein said carrier is selected from the group consisting of nonionic surfactants, fatty acids, sodium carboxymethylcellulose, gelatin, polyethylene glycol, fatty alcohols, sodium triphosphate, potassium triphosphate, disodium orthophosphate, magnesium sulfate, silica, clay, alumino silicates, water and mixtures thereof.

* * * * *

UNITED STATES PATENT AND TRADEMARK OFFICE

CERTIFICATE OF CORRECTION

PATENT NO. : 4,422,950

DATED : December 27, 1983

INVENTOR(S) : Kemper et al.

It is certified that error appears in the above—identified patent and that said Letters Patent is hereby corrected as shown below:

Column 8, line 36 (Claim 8) change "$(NaBO_2 \cdot H_2O_2)$" to read --$(NaBO_2 \cdot H_2O)$--.

Signed and Sealed this

*Tenth* Day of *April 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,422,950

DATED : December 27, 1983

INVENTOR(S) : Kemper et al.

It is certified that error appears in the above—identified patent and that said Letters Patent is hereby corrected as shown below:

Column 8, line 36 (Claim 8) change "($NaBO_2 \cdot H_2O$)" to -- ($NaBO_2 \cdot H_2O_2$) --.

Signed and Sealed this

*Twenty-third* Day of *October 1984*

[SEAL]

*Attest:*

GERALD J. MOSSINGHOFF

*Attesting Officer*

*Commissioner of Patents and Trademarks*